United States Patent [19]

Ordinaga Llorens

[11] 4,006,897

[45] Feb. 8, 1977

[54] SIMULATED TENNIS GAME

[75] Inventor: Eliseo Ordinaga Llorens, Valencia, Spain

[73] Assignee: Cremeal S.A., Valencia, Spain

[22] Filed: Feb. 28, 1975

[21] Appl. No.: 554,325

[30] Foreign Application Priority Data

| | | |
|---|---|---|
| Mar. 1, 1974 | Spain | 201078[U] |
| July 12, 1974 | Spain | 204600[U] |
| July 12, 1974 | Spain | 204601[U] |

[52] U.S. Cl. ..... 273/85 R; 273/1 E

[51] Int. Cl.[2] ..... A63F 9/14

[58] Field of Search ..... 273/1 E, 85 R, 101.1, 273/101.2, 105.1, DIG. 28, 1 M, 85 F, 94 R; 46/239, 240; 35/66

[56] References Cited

UNITED STATES PATENTS

| | | | |
|---|---|---|---|
| 3,055,113 | 9/1962 | Grandjean | 35/66 |
| 3,231,988 | 2/1966 | Freyde | 46/240 |
| 3,605,334 | 9/1971 | Genin | 46/240 |
| 3,617,064 | 11/1971 | Collup | 273/85 R |
| 3,702,190 | 11/1972 | Waldrop | 273/94 R |
| 3,778,058 | 12/1973 | Rausch | 273/85 R |

*Primary Examiner*—Anton O. Oechsle
*Assistant Examiner*—Harry G. Strappello
*Attorney, Agent, or Firm*—Wenderoth, Lind & Ponack

[57] ABSTRACT

A skilled game, of the simulated tennis or table tennis type, includes a translucent screen representing the playing field, through which a movable point representing the ball and rectilineal segments representing raquets or players are visible. Both the movable point and segments advantageously are luminous. The movable point is simultaneously provided with both longitudinal and transverse reciprocating displacements which achieve a zig-zag path of travel of the ball, as if it were bouncing between the raquets and the lateral borders of the playing field or screen. The raquets or segments are provided with a transversal movement parallel to the border lines of the playing field, which displacements are controlled by manual activating controls for each player.

11 Claims, 7 Drawing Figures

SIMULATED TENNIS GAME

BACKGROUND OF THE INVENTION

The present invention relates to a skilled game, of the type to resemble tennis or table tennis, and which basically includes a translucent screen representing a playing field, a movable point representing a ball, and two rectilinearly moving segments representing raquets or players. The complete assembly is illuminated for a better vision of the parts. The ball is mounted for free movement across the field for impact against the boundaries thereof or the segments. The segments are mounted for transverse movement parallel to the end boundaries of the playing field.

SUMMARY OF THE INVENTION

According to a preferred embodiment of the invention, movement of the ball in a direction between the end boundaries of the field is achieved by the point representing the ball being mounted on the end of a vertical arm joined to a sliding element which is moved longitudinally along a guide arm by a chain or endless belt which extends between pulleys arranged at the ends of the guide arm, one of the pulleys receiving power from an electric motor reducing group.

Movement of the ball in a direction parallel to the end boundaries of the field is obtained by means of another electric motor reducing group which operates another chain or belt suspended between pulleys, such belt displacing the guide arm in a transverse direction.

Movement of the segments or raquets is achieved by use of chains or endless belts mounted about sets of pulleys and attached to the segments, the movement of such chains or belts being manual and at the will of each player.

Movement of the guide arm is limited by abutments connected to a polarity changeover switch for the feed of the motor reducing group which moves the endless belts which cause transverse movement to the guide arm.

The specific or actual movement of the ball is obtained by the combination of the two movements described above, that is by the transverse movement of the guide arm and by the longitudinal movement of the sliding element which carries the ball along the arm. Thus, the ball undergoes a zig-zag movement or angular movement similar to that of a billiard ball.

Another practical embodiment of the invention involves solidly joining the point representing the ball to a type of carriage which can be displaced along the guide arm, by providing such carriage with a motor reducing group which drives a pinion meshed with a rack longitudinally provided in the guide arm.

Such guide arm is in turn provided with another motor reducing group which drives a shaft mounted on the guide arm, which shaft has at its ends pinions which mesh with racks arranged parallel to each other and which form lateral displacement guides for moving the guide arm longitudinally along the frame.

As in the case of a chain or endless belt transmission arrangement, in this embodiment of the invention the simultaneous operation of the motor reducing groups causes a zig-zag type of displacement of the ball, and movement of the segments or raquets is achieved by sets of pulleys and endless belts which are operated at will by the players.

BRIEF DESCRIPTION OF THE DRAWINGS

Other objects and features of the invention will become apparent from the following description taken with the accompanying drawings, wherein.

DETAILED DESCRIPTION OF THE INVENTION

Figure 1:
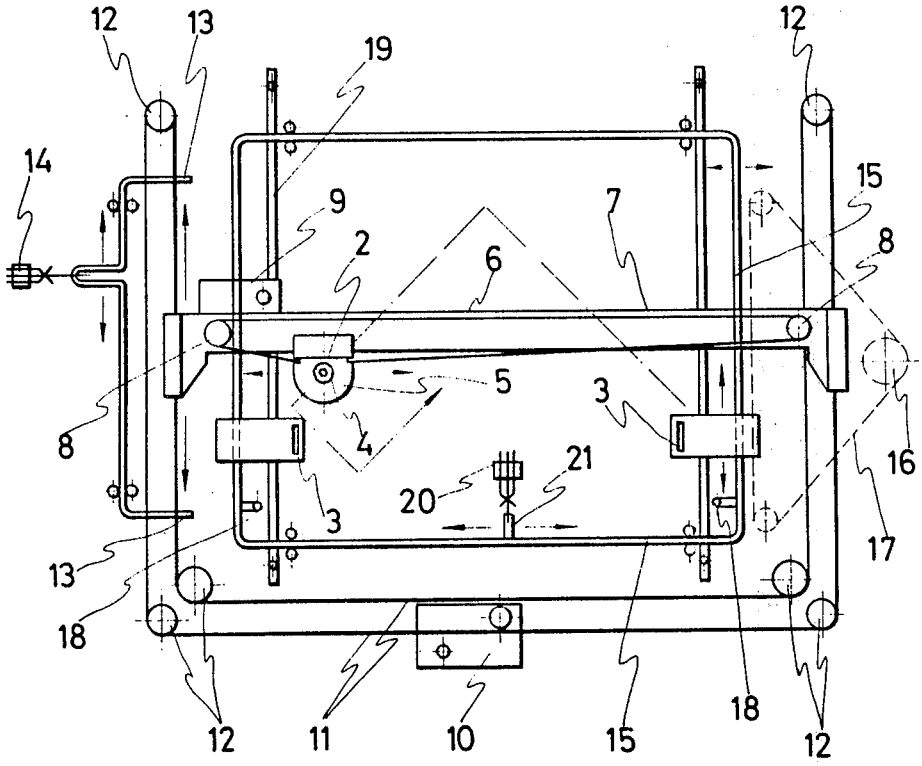
FIG. 1 is a schematic illustration of one embodiment of the skilled game of the present invention, such illustration showing a pulley and chain or endless belt movement arrangement.

As can be seen from the drawings, the skilled game of the present invention includes a translucent screen 1 (FIG. 3) representing the playing field, through which a movable point 2, representing the ball, and at least two rectilineal segments 3, acting as raquets or players, are visible. Both the movable point 2 and the rectilineal segments 3 have luminous characteristics.

In the embodiment of FIG. 1, the movable point 2 is solidly fixed to the end of a vertical arm 4 which, in turn, is connected to a sliding element 5 which can be displaced longitudinally along a guide arm 6, such displacement being effected by a chain or endless belt 7 mounted between pulleys 8 mounted on the guide arm 6. One of the pulleys 8 is rotated by a motor reducing group 9.

Transversal movement of the ball 2, in the example shown in FIG. 1, is obtained by a motor reducing group 10 which moves or displaces the guide arm 6 by means of a chain or endless belt 11 connected to guide arm 6 and suspended between pulleys 12, arranged in the manner shown in FIG. 1.

Movement of guide arm 6 is reversed and limited by abutments 13 connected to a polarity changeover switch 14 connected to electric motor reducing group 10.

Segments 3 are mounted on a frame 15 and can be displaced thereon by means of manual controls 16 (only one of which is shown), each having a set of pulleys around which extends an endless belt 17, belt 17 being connected to segment 3.

Movement of segments 3 is limited by abutments 18 adjacent transverse rods 19.

Switch 20 for motor reducing group 9 has a polarity inversion operating appendix 21 mounted on the displacement frame 15.

Figure 2:
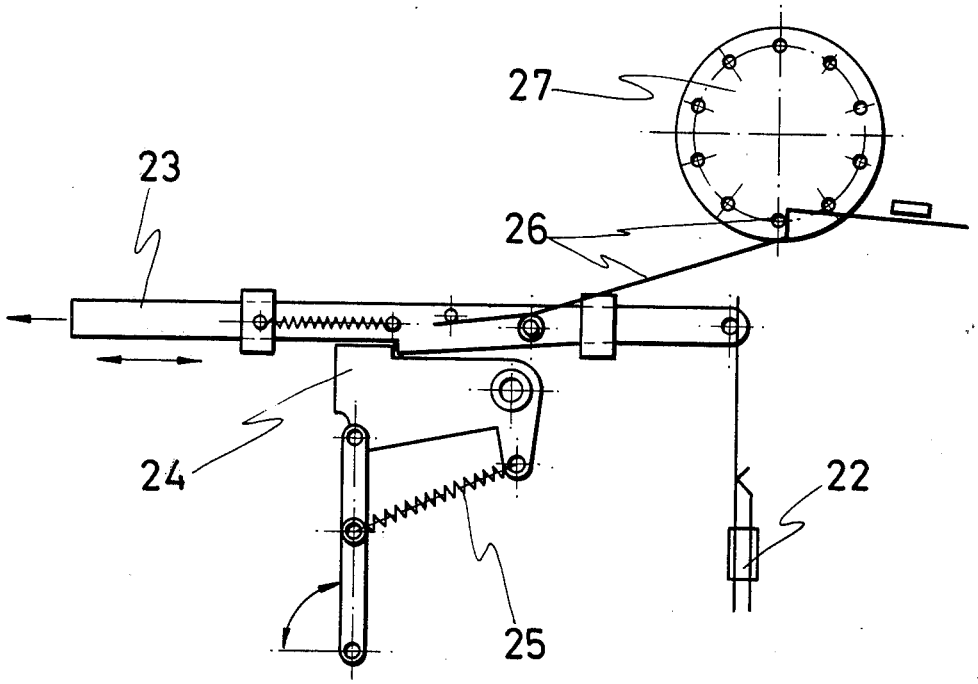
FIG. 2 is a schematic view of a scoring system employable in the device of the invention.

The skilled game generally has an electric feed switch 22 and a push button 23 activating control of switch 22. The push button 23 can be locked as shown in FIG. 2 by the interlocking element 24 mounted on transverse rod 19 in the embodiment of FIG. 1. Element 24 has thereon a recovery spring 25, and push button 23 also has a recovery spring.

By means of a ratchet device 26 the switch is connected to a marking disc 27 to indicate the score or points of each player.

Figure 3:
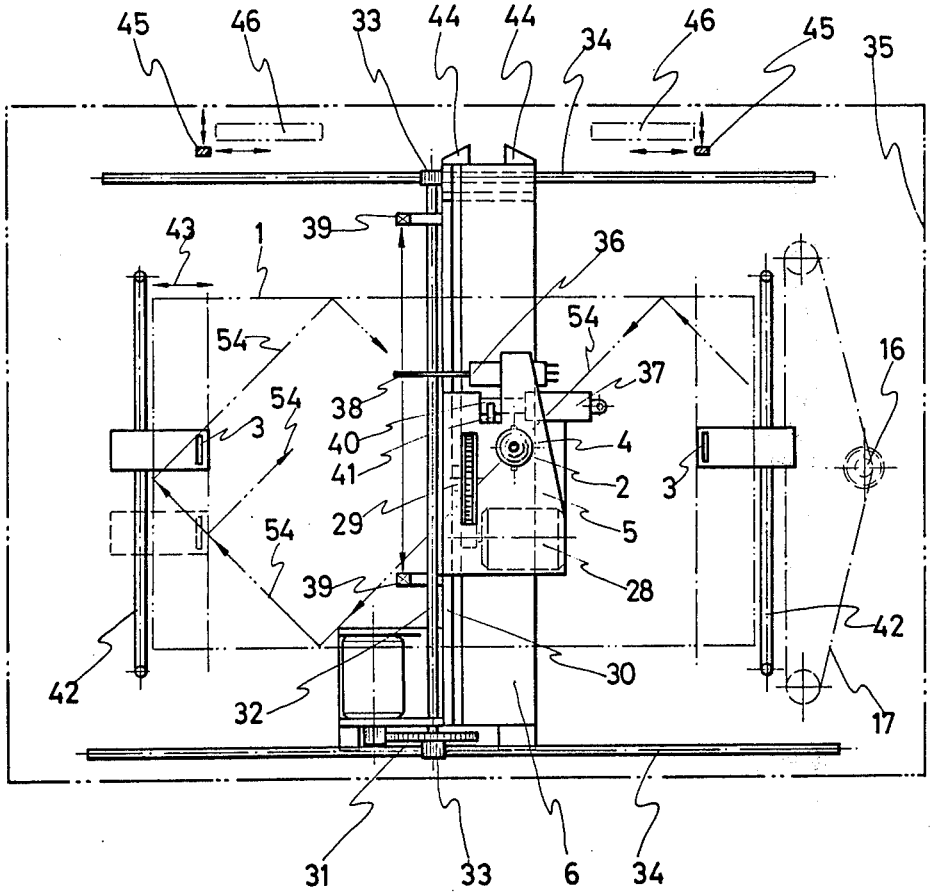
FIG. 3 is a schematic illustration of a second embodiment of the invention, employing a pinion and rack moving arrangement.

In the embodiment of FIG. 3, the sliding element 5 is a carriage which is displaced along the guide arm 6 by providing carriage 5 with a motor reducing group 28 which drives a pinion 29 meshing with a longitudinal rack 30 on guide arm 6.

The guide arm 6 is, in turn, provided with a second motor reducing group 31 which activates a shaft 32 longitudinal to guide arm 6. The ends of shaft 32 are provided with pinions 33 which mesh with racks 34 respectively arranged parallel to each other and which constitute lateral displacement guides for guide arm 6 along the frame 35 of the game.

The sliding element or carriage 5 has microswitches 36 and 37 having two positions, which act as polarity changeover switches for the feed of the electric motors of the groups 28 and 31 of carriage 5 and of guide arm 6, respectively.

Activating lever 38 of microswitch 26, which controls the feed of the motor reducing group 28 of the carriage 5, is positioned between abutments 39 arranged on guide arm 6. Abutments 39 limit and control the reciprocating movement of the carriage 5. The activating lever 40 of the microswitch 37, which controls the feed of the motor reducing group 31 of guide arm 6, is connected to the lower end 41 of the arm 4 constituting the movable point or ball 2. The top end of arm 4 is housed between abutments 42 representing the border lines of the playing field. Abutments 42 cause lateral or oscillating movement of arm 4, which movement causes microswitch 37, which controls guide arm 6, to function. Abutments 42 establish the limits of the reciprocating movement of guide arm 6.

At areas 43, at the lateral ends of the device, abutments 44 on guide arm 6 activate levers 45 of point or score counters 46.

Figure 4:
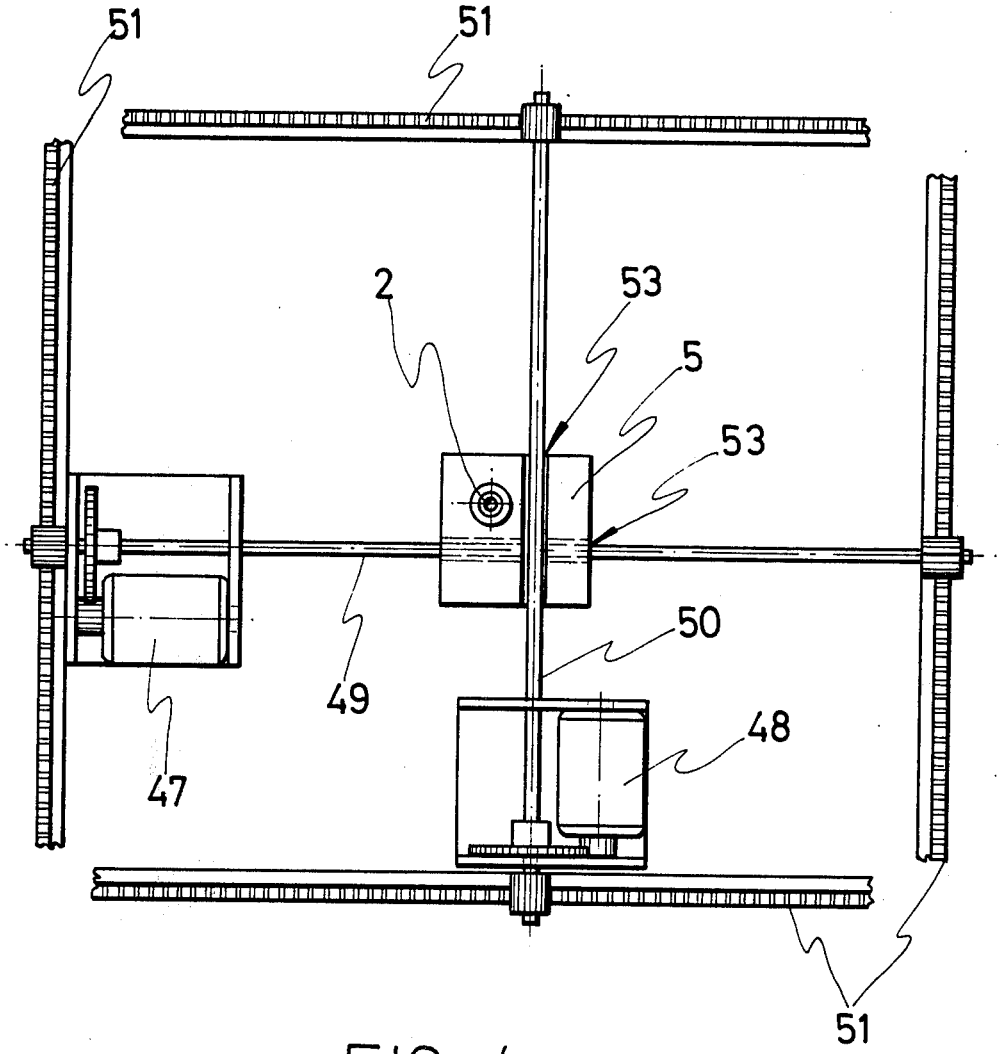
FIG. 4 is a schematic illustration showing rack and pinion movement of a sliding element carrying the ball in both longitudinal and transverse directions.
Figure 6:
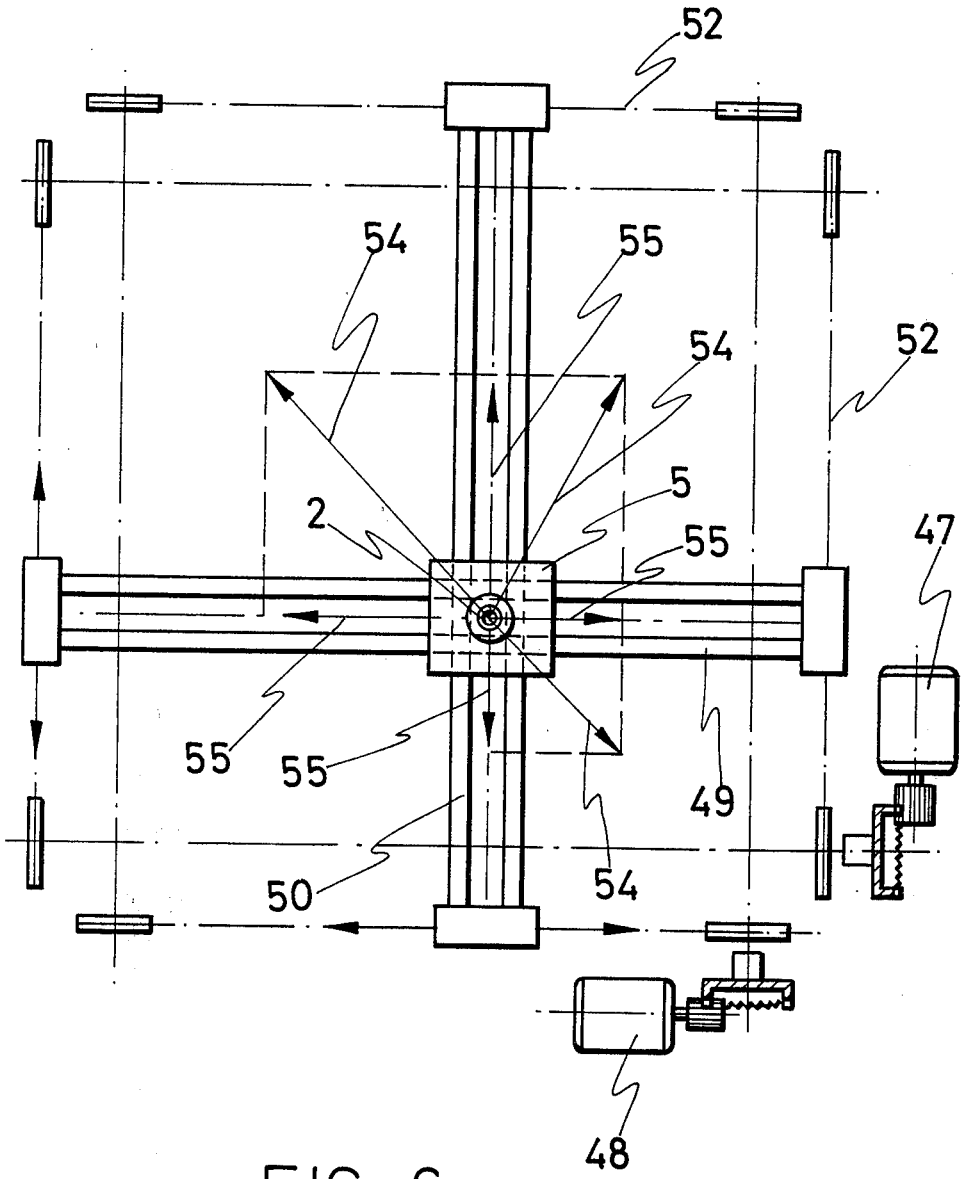
FIG. 6 is a schematic illustration showing a chain or endless belt drive system wherein a sliding element is moved along two pairs of orthogonal arms in both transverse and longitudinal directions.

The drive system for ball 2 may alternatively comprise, as shown in FIGS. 4 and 6, two independent motor reducing groups 47 and 48, which respectively laterally displace orthogonally crossed arms 49 and 50, by a rack transmission system 51 as shown in FIG. 4, or by a chain or endless belt system 52 as shown in FIG. 6.

Functioning of the embodiment illustrated in FIG. 1 is simple. When the ball 2 reaches any of the sidelines of the field, due to abutments 13 and switch 14, motor 10 and arm 6 are reversed, while element 5 continues in the same direction. When the ball contacts a raquet 3, element 5 causes movement of frame 15, thereby activating switch 20 and reversing motor 9 and element 5, while arm 6 continues in the same direction. Thus, an authentic "bouncing" effect is achieved.

However, when the ball reaches an end line, i.e. is not blocked by a raquet or segment 3, element 5 contacts rod 19, and the general circuit is disconnected, thus stopping all movement. Therefore, in order to again start the game, it is necessary to activate push button 23 (FIG. 2) wherein ratchet device 26 causes the respective marking disc 27 to advance, and the score or point is reflected.

The simultaneous operation of the motor reducing groups 28 and 31 in the embodiment of FIG. 3 causes displacement, along an oblique line 54, of the movable point or ball 2 with respect to the displacement of the sliding element or carriage 5 of the guide arm 6.

According to the path of ball 2 along particular oblique lines 54, each player attempts to position his respective segment 3 in the path of the movable point 2, by means of positioning controls 16 for segments 3. Should the path 54 of the movable point 2 not have been blocked by a segment 3, then abutment 44 will activate lever 45, and the player on the opposite side will score a point.

On the contrary, if the path 54 of point 2 has been blocked by the correct positioning of the respective segment 3, the game continues in such a way that the movable point 2 will return to the opposite zone whereat the player at such zone will attempt to block the path of point or ball 2.

Figure 5:
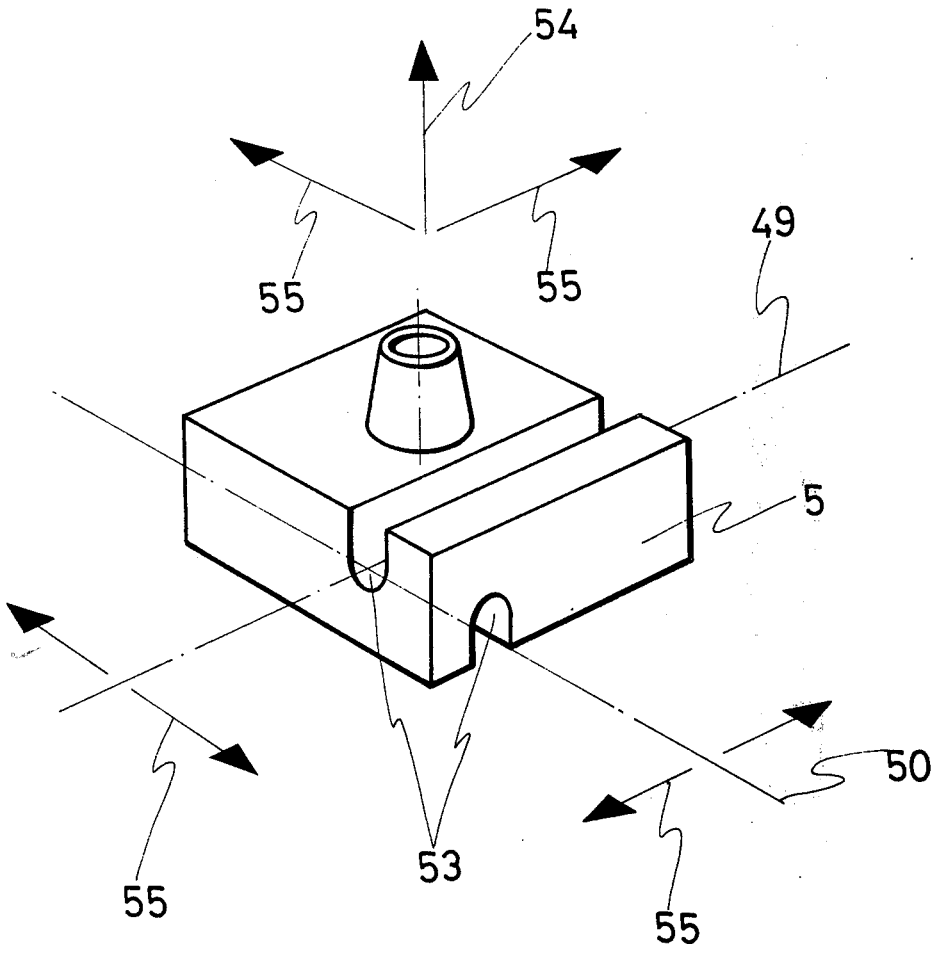
FIG. 5 is a schematic perspective view of the sliding element shown in FIG. 4.
Figure 7:
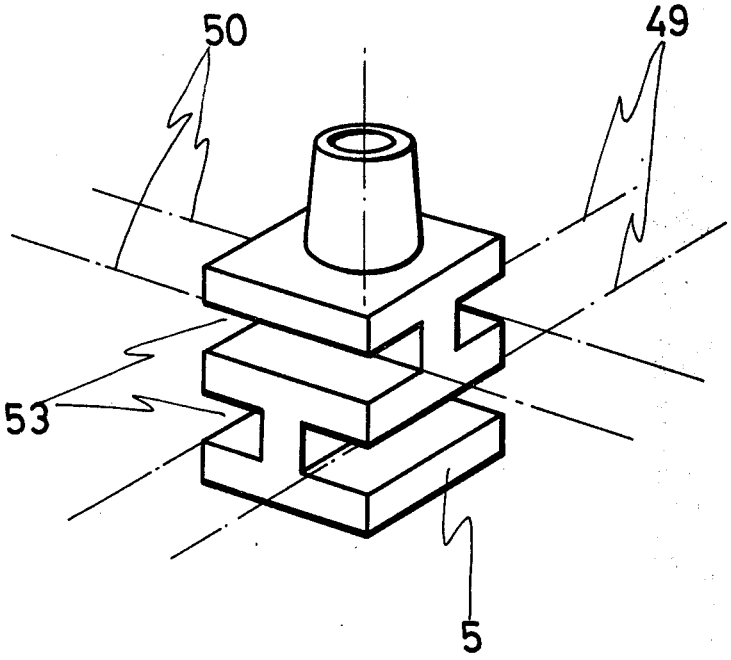
FIG. 7 is a schematic perspective view of the sliding element used in the drive system illustrated in FIG. 6.

FIGS. 5, 6 and 7, besides indicating vector paths 54 of element 5 due to displacement of arms 49 and 50, since the motor reducing groups 47 and 48 operate simultaneously, also indicate the paths 55 of the arms 49 and 50, when motor reducing groups 47 and 48 act independently of each other.

I claim:

1. A skilled game of simulated tennis or table tennis type, said game comprising:

a frame;

a translucent screen supported by said frame and representing a playing court, said screen having opposite side edges representing lateral boundaries of said court and opposite end edges representing end lines of said court;

a luminous point representing a ball supported for zig-zag type movement beneath said screen, each said zig-zag type movement being the resultant vector from simultaneous movement of said point between said lateral boundaries and between said end lines;

a pair of segments representing raquets or players, one each slidably mounted on a transverse bar support adjacent a respective one of said end lines for transverse movement therealong between said lateral boundaries;

a pair of segment movement means, one each operatively connected to a respective one of said segments, for selectively and manually moving said segments along said respective transverse bar supports between said lateral boundaries;

a first reversible motor;

first point movement means, operable by said first motor, for moving said point between said lateral boundaries;

first switch means, connected to said first motor, for reversing the direction of said first motor and said first point movement means upon movement of said point to one of said lateral boundaries;

a second reversible motor;

second point movement means, operable by said second motor, for moving said point between said end lines; and second switch means, connected to said second motor, for reversing the direction of said second motor and said second point movement means upon movement of said point to one of said end lines when the respective said segment has been manually moved to a position to block the path of movement of said point.

2. A game as claimed in claim 1, wherein said segment movement means each comprise an endless belt attached to the respective said segment and mounted about a plurality of pulleys, and a manual control connected to said belt.

3. A game as claimed in claim 1, wherein said first point movement means comprises a guide arm extending longitudinally of said screen, and a first endless belt or chain means connected to said guide arm and said first motor and supported by plural pulleys for moving said guide arm transversely between said lateral boundaries; and wherein said second point movement means comprises a sliding element slidably mounted on said guide arm, and a second endless belt or chain means connected to said sliding element and said second motor and supported by plural pulleys on said guide arm for moving said sliding element longitudinally along said guide arm between said end lines.

4. A game as claimed in claim 3, further comprising third switch means, connected to said first and second motors, for stopping said first and second motors and thus the game upon movement of said sliding element to one of said end lines only when the respective said segment has not been manually moved to a position to block the path of movement of said sliding element.

5. A game as claimed in claim 4, further comprising a score counter; a start switch connected to said first and second motors to start the game; and a ratchet means connected to said start switch and operatively engageable with said score counter for activating said score counter to indicate a change in the score of the game upon restarting of the game by actuation of said start switch.

6. A game as claimed in claim 1, wherein said second point movement means comprises a guide arm extending transversely of said screen, racks extending longitudinally of said screen adjacent said lateral boundaries, and pinions connected to said guide arm and meshing with said racks, said pinions being driven by said second motor to move said guide arm longitudinally between said end lines; and wherein said first point movement means comprises a carriage mounted on said guide arm, a rack on said guide arm, said carriage having a pinion meshing with said rack, and said pinion being driven by said first motor to move said carriage transversely between said lateral boundaries.

7. A game as claimed in claim 6, wherein said second switch means further comprises means for reversing the direction of said second motor and said guide arm upon movement of said point to one of said end lines when the respective said segment has not been manually moved to a position to block the path of movement of said point.

8. A game as claimed in claim 7, further comprising a pair of abutments on one lateral end of said guide arm; a pair of levers, one each positioned along the respective said lateral boundary adjacent said respective end lines at locations to be contacted by a respective said abutment when said guide arm moves to said respective end line when said respective segment does not block the path of said point; and a pair of score counter means, one each connected to an oppositely situated said lever, for indicating a change in the score of the game when the path of said point is not blocked by the oppositely situated segment.

9. A game as claimed in claim 1, wherein said first point movement means comprises a first guide arm extending longitudinally of said screen and movable transversely between said lateral boundaries; and said second point movement means comprises a second guide arm extending transversely of said screen and movable longitudinally between said end lines; said first and second guide arms being orthogonally arranged; and further comprising a sliding element slidably attached to both said first and second guide arms, said point being supported on said sliding element.

10. A game as claimed in claim 9, further comprising first and second endless belt or chain means, operatively connected to said first and second motors, respectively, for moving said first and second guide arms, respectively.

11. A game as claimed in claim 9, further comprising a first pair of racks, one each positioned adjacent one of said end lines; a second pair of racks, one each positioned adjacent one of said lateral boundaries; a first pair of pinions, one each on opposite ends of said first guide arm and meshing with a respective one of said first racks; a second pair of pinions, one each on opposite ends of said second guide arm and meshing with a respective one of said second racks; said first pinions being driven by said first motor; and said second pinions being driven by said second motor.

* * * * *